US012729886B2

(12) United States Patent
Cohen

(10) Patent No.: US 12,729,886 B2
(45) Date of Patent: Sep. 8, 2026

(54) COOLING SYSTEM INCLUDING HYDRAULIC LIQUID-REFRIGERANT COMPRESSORS AND EXPANDERS FOR DELIVERING PRESSURIZED LIQUID TO THE COMPRESSORS

(71) Applicant: Shay Cohen, Rehuvut (IL)

(72) Inventor: Shay Cohen, Rehuvut (IL)

( * ) Notice: Subject to any disclaimer, the term of this patent is extended or adjusted under 35 U.S.C. 154(b) by 102 days.

(21) Appl. No.: 18/869,647

(22) PCT Filed: May 31, 2023

(86) PCT No.: PCT/IL2023/050565

§ 371 (c)(1),
(2) Date: Nov. 26, 2024

(87) PCT Pub. No.: WO2023/233409

PCT Pub. Date: Dec. 7, 2023

(65) Prior Publication Data

US 2025/0354726 A1 Nov. 20, 2025

Related U.S. Application Data

(60) Provisional application No. 63/365,505, filed on May 31, 2022.

(51) Int. Cl.

| | |
|---|---|
| ***F25B 9/06*** | (2006.01) |
| ***F25B 9/00*** | (2006.01) |
| ***F25B 41/20*** | (2021.01) |

(52) U.S. Cl.

CPC ..... *F25B 9/06* (2013.01); *F25B 9/008* (2013.01); *F25B 41/20* (2021.01)

(58) Field of Classification Search

CPC .. F25B 9/06; F25B 9/008; F25B 41/20; F25B 2309/06

See application file for complete search history.

(56) References Cited

U.S. PATENT DOCUMENTS

| | | | | |
|---|---|---|---|---|
| 8,450,884 | B2 | 5/2013 | Stahlkopf | |
| 9,671,144 | B1 * | 6/2017 | El-Shaarawi | F25B 41/24 |
| 10,288,325 | B2 | 5/2019 | Vaisman | |

FOREIGN PATENT DOCUMENTS

| | | |
|---|---|---|
| DE | 10245694 A1 | 4/2004 |
| WO | 2022/168098 | 8/2022 |

OTHER PUBLICATIONS

International Search Report and Written Opinion issued Sep. 19, 2023, in international application No. PCT/IL2023/050565.

* cited by examiner

*Primary Examiner* — Joseph F Trpisovsky

(57) ABSTRACT

A chiller includes a plurality of hydraulic compression units, each compression unit configured to compress a refrigerant at gaseous state with liquid and exhaust the compressed refrigerant; a condenser for condensing the compressed refrigerant; a plurality of expander units, each expander unit configured to expand condensed refrigerant into a vapor-liquid mixture, to displace liquid during expansion of the condensed refrigerant, and to displace the expanded vapor-liquid mixture of refrigerant through introduction of liquid; an evaporator for evaporating the expanded refrigerant; a conduit for delivering the evaporated refrigerant back to the hydraulic compression units; and a plurality of valves configured between the plurality of expander units and hydraulic compression units, such that the liquid displaced from each expander unit is delivered to a hydraulic compression unit to thereby assist in the exhaust of the compressed refrigerant.

25 Claims, 12 Drawing Sheets

COOLING SYSTEM INCLUDING HYDRAULIC LIQUID-REFRIGERANT COMPRESSORS AND EXPANDERS FOR DELIVERING PRESSURIZED LIQUID TO THE COMPRESSORS

RELATED APPLICATIONS

This Application claims priority to U.S. Provisional Patent Application 63/365,505, filed May 31, 2022, entitled "Advanced Cooling System Based on CO2 and a Hydraulic Isothermal Compressor and Expander," and to PCT International application No. PCT/IL2023/050565, filed May 31, 2023, entitled "COOLING SYSTEM INCLUDING HYDRAULIC LIQUID-REFRIGERANT COMPRESSORS AND EXPANDERS FOR DELIVERING PRESSURIZED LIQUID TO THE COMPRESSORS," the contents of each of which are incorporated by reference as if fully set forth herein.

FIELD OF THE INVENTION

The present Application relates to the field of cooling systems. More specifically, the present application relates to systems and methods of cooling by compressing carbon dioxide with hydraulic pistons, expanding the condensate carbon dioxide in hydraulic expanders, and using the liquid displaced during the expansion in order to assist the compression process and thus to reduce the overall power consumption.

BACKGROUND OF THE INVENTION

One major component of the cost of maintaining air conditioning systems, also known as chillers, is electricity consumption. An estimated 3.3 billion room air-conditioning units will be installed in the world between today and 2050. Most of these units are inefficient, and will place a significant burden on electricity grid infrastructure and consumers, especially in developing countries. Drastic transformation of residential cooling technology through innovation can improve people's health, productivity, and well-being.

In addition, the planet is getting hotter. Already, 30 percent of the world's population is exposed to potentially dangerous heat conditions. By 2100, up to three-quarters could be at risk. Affordable cooling is becoming a global necessity, allowing for increased productivity, positive health outcomes, and accelerated economic development.

International Patent Publication WO 2022/168098A1, entitled "Systems and Methods for Compressing, Storing, and Expanding Refrigerant in Order to Supply Low-Cost Air Conditioning," discloses energy storage systems for use in a HVAC cycle. The energy storage systems capture energy generated by compression of gas with hydraulic pistons during periods of low energy consumption, and release of that energy during periods of high energy consumption. In addition, that application discloses the use of an expander to at least partially recapture energy of expansion of the gas, for use in the compression performed by the hydraulic pistons. The expander includes a first cylinder, a U-shaped duct, and a second cylinder connected in series. The first cylinder is connected to a source of compressed refrigerant and an evaporator. The second cylinder is connected to a liquid pump and to a low-pressure liquid reservoir. During expansion of refrigerant, compressed refrigerant enters the first cylinder from the source of compressed refrigerant, and displaces liquid from the first cylinder, duct, and second cylinder to the liquid pump. Following expansion of refrigerant, liquid from the low-pressure liquid reservoir enters the second cylinder, duct, and first cylinder to thereby evacuate expanded refrigerant from the expander into the evaporator and refill the expander with liquid.

SUMMARY OF THE INVENTION

The present disclosure teaches a practical implementation of a chilling system, based on hydraulic compression of gas, in which an expander captures power of expansion of the compressed refrigerant in order to partially power the compression of gas. In one particular implementation, the chilling system includes an integrated network of four hydraulic compression cylinders for compressing gas with pumped liquid. The system further includes two expander units for displacing liquid with the expanding gas and pumping this liquid back to the compression cylinders, for exhausting of compressed gas. The compression cylinders and expanders are integrated within a synchronized cycle of compression, condensation, expansion, and evaporation, in which the evaporation stage is used for cooling.

Advantageously, the use of the expanders, in place of an expansion valve which is commonly used in chilling cycles, enables two distinct energetic benefits. First, the energy of expansion is captured by the expander units to thereby reduce the energy required for compression. This reduces the energy required for compression by up to approximately 25%. Second, the expansion proceeds in a nearly isentropic process, such that the expanded refrigerant exits the expander as a saturated liquid-gas mixture. This, in turn, results in a higher percentage of the refrigerant entering the evaporator as a liquid, which, in turn, improves the energetic performance of the evaporator by up to approximately 17%.

Further advantageously, the system uses natural materials that do not harm the environment as current refrigerants do. Carbon dioxide as a refrigerant has a global warming potential (GWP) of just 1 and an ozone depletion potential (ODP) of zero. Carbon dioxide as a refrigerant is also non-explosive and non-flammable. The life expectancy of the system is 40 years requiring minimal maintenance, resulting in low operating expenses. The system is quiet and not noisy as standard chillers are.

The system may be deployed as a central air conditioning module or water chilling module in factories, skyscrapers, buildings, malls, and private houses.

According to a first aspect, a chiller is disclosed. The chiller includes: a plurality of hydraulic compression units, each compression unit configured to compress a refrigerant at gaseous state with liquid and exhaust the compressed refrigerant; a condenser for condensing the compressed refrigerant; a plurality of expander units, each expander unit configured to expand condensed refrigerant into a vapor-liquid mixture, to displace liquid during expansion of the condensed refrigerant, and to displace the expanded vapor-liquid mixture of refrigerant through introduction of liquid; an evaporator for evaporating the expanded refrigerant; a conduit for delivering the evaporated refrigerant back to the hydraulic compression units; and a plurality of valves configured between the plurality of expander units and hydraulic compression units, such that the liquid displaced from each expander unit is delivered to a hydraulic compression unit to thereby assist in the exhaust of the compressed refrigerant.

In another implementation according to the first aspect, each compression unit receives liquid for compression alternatively from a suction tank or from one of the plurality of expander units.

In another implementation according to the first aspect, the compression units are arranged to operate in cycles of four stages: beginning of suction of refrigerant; advanced suction of refrigerant; compression; and evacuation of compressed refrigerant to a condenser. Optionally, the compression units are arranged in groups of four, such that, at any given moment, each compression unit is operating a different stage of the four-stage compression cycle. Optionally, at any given moment, a first pump delivers liquid from a suction tank to the compression unit that is in the compression phase, a second pump delivers liquid from a first expander unit to the compression unit that is in the evacuation phase, and a third pump delivers liquid from the suction tank to a second expander unit.

Optionally, the plurality of expander units comprise two expander units for every group of four compression units, wherein, during each cycle of the four compression units, one of the two expander units fills with liquid from the suction tank, thereby displacing expanded refrigerant in a liquid-vapor mixture to the evaporator, and a second of the expander units fills with condensed refrigerant which expands therein into a liquid-vapor mixture, thereby displacing liquid for delivery to the compression unit that is in the evacuation phase.

Optionally, each expander unit contains an inner chamber with refrigerant in a liquid state, an outer chamber with liquid water, and refrigerant in vapor state between the inner and outer chambers, wherein the vapor refrigerant divides between the liquid state refrigerant and the liquid water.

In another implementation according to the first aspect, the evaporator is configured to draw heat from an ambient fluid to thereby evaporate the refrigerant while chilling the ambient fluid.

In another implementation according to the first aspect, the chiller includes a recuperator, the recuperator comprising a first pathway configured between the condenser and plurality of expander units, and a second pathway configured between the evaporator and the plurality of the compression units, wherein the recuperator is configured to cool incoming condensed refrigerant in the first pathway and heat outgoing evaporated refrigerant from the second pathway.

In another implementation according to the first aspect, the liquid is water and the gas is carbon dioxide. Optionally, in the condenser, the carbon dioxide is pressurized to 70 bar and raised to a temperature of 29° C., and, upon entry into the evaporator, the carbon dioxide is at a pressure of 38.6 bar and at a temperature of 4° C.

In another implementation according to the first aspect, the liquid has a freezing point below 0° C., and, upon entry into the evaporator, the refrigerant is below 0° C.

According to a second aspect, a method of chilling is disclosed. The method includes: compressing refrigerant with liquid in a plurality of hydraulic compression units; exhausting the compressed refrigerant from the hydraulic compression units; condensing the compressed refrigerant in a condenser; expanding the condensed refrigerant in a plurality of expander units into a vapor-liquid mixture, thereby displacing liquid, delivering the displaced liquid from each expander unit to a hydraulic compression unit, to thereby assist in the exhaust of the compressed refrigerant, and displacing the expanded vapor-liquid mixture of refrigerant through introduction of liquid; evaporating the expanded refrigerant in an evaporator; and delivering the evaporated refrigerant back to the hydraulic compression units.

In another implementation according to the second aspect, the method further includes alternatively delivering liquid to each compression unit from a suction tank or from one of the plurality of expander units.

In another implementation according to the second aspect, the method further includes operating the compression units in cycles in four stages: beginning of suction of refrigerant; advanced suction of refrigerant; compression; and evacuation of compressed refrigerant to a condenser.

Optionally, the compression units are arranged in groups of four, such that, at any given moment, each compression unit is operating a different stage of the four-stage compression cycle.

Optionally, at any given moment, a first pump delivers liquid from a water suction tank to the compression unit that is in the compression phase, a second pump delivers liquid from a first expander unit to the compression unit that is in the evacuation phase, and a third pump delivers liquid from the water suction tank to a second expander unit.

Optionally, the plurality of expander units comprise two expander units for every group of four compression units, wherein, during each cycle of the four compression units, one of the two expander units fills with liquid from the water suction tank, thereby displacing expanded refrigerant in a liquid-vapor mixture to the evaporator, and a second of the expander units fills with condensed refrigerant which expands therein into a liquid-vapor mixture, thereby displacing liquid for delivery to the compression unit that is in the evacuation phase.

Optionally, each expander unit contains an inner chamber with refrigerant in a condensate state, an outer chamber with liquid, and refrigerant in vapor state between the inner and outer chambers, wherein the vapor refrigerant divides between the condensate refrigerant and the liquid.

In another implementation according to the second aspect, the method further includes, during the evaporating step, drawing heat with the evaporator from ambient fluid to thereby evaporate the refrigerant while chilling the ambient fluid.

In another implementation according to the second aspect, the method further includes cooling incoming condensed refrigerant in a first pathway of a recuperator configured between the condenser and plurality of expander units, and heating outgoing evaporated refrigerant in a second pathway of the recuperator configured between the evaporator and the plurality of the compression units.

In another implementation according to the second aspect, the liquid is water and the refrigerant is carbon dioxide. Optionally, in the condenser, the carbon dioxide is pressurized to 70 bar and raised to a temperature of 29° C., and, upon entry into the evaporator, the carbon dioxide is at a pressure of 38.6 bar and at a temperature of 4° C.

In another implementation according to the second aspect, the liquid has a freezing point below 0° C., and, upon entry into the evaporator, the refrigerant is below 0° C.

In another implementation according to the second aspect, the method further includes cooling the compression units during the compressing step to thereby compress the refrigerant in the compression units isothermally.

DETAILED DESCRIPTION OF THE INVENTION

Figure 1:
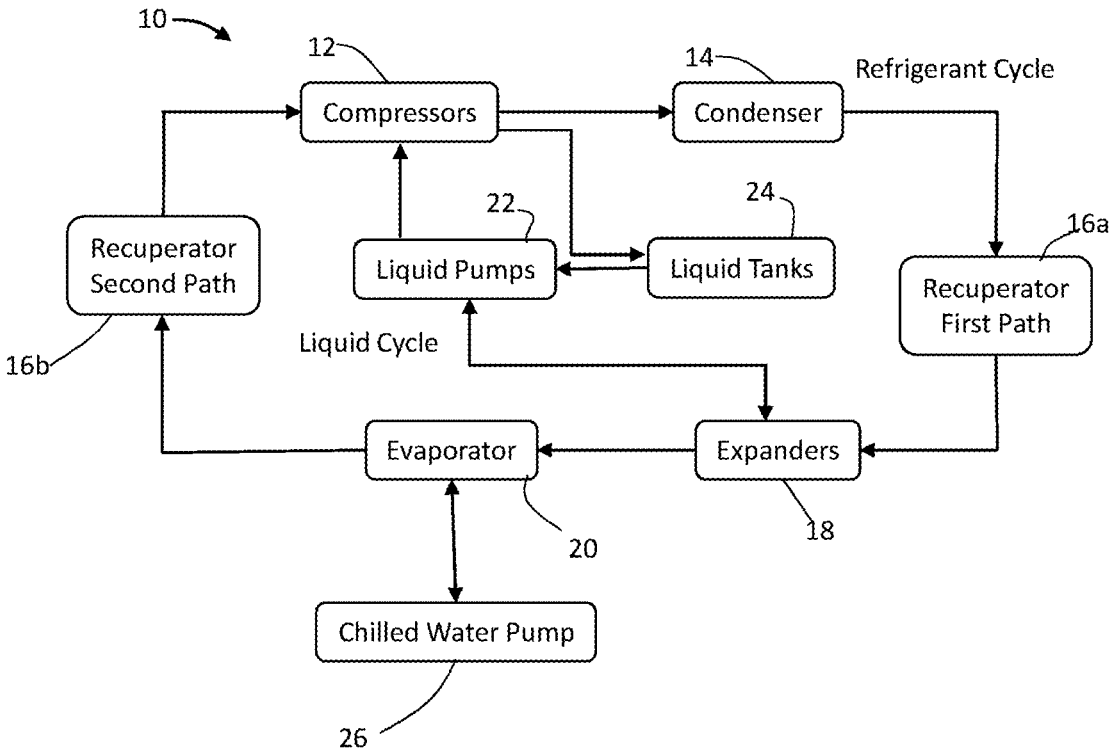
FIG. 1 schematically illustrates components of a cooling system, according to embodiments of the present disclosure.

The present Application relates to the field of cooling systems. More specifically, the present application relates to systems and methods of cooling by compressing carbon dioxide with hydraulic pistons, expanding the condensate carbon dioxide in hydraulic expanders, and using the liquid displaced during the expansion in order to exhaust compressed gas from the hydraulic pistons.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring to FIG. 1, air conditioning system 10 is illustrated schematically as having two integrated, continuously operating cycles: a refrigerant cycle, illustrated in the outer loop, and a liquid cycle, represented by the inner components. In the refrigerant cycle, a refrigerant is sequentially compressed with compressors 12, condensed with condenser 14, expanded with expanders 18, and evaporated with evaporator 20. The evaporation supplies cooling power by withdrawal of heat from the surrounding atmosphere, such as from water supplied by chilled water pump 26. This chilled water may then be recirculated to an HVAC client, e.g. to a building, to provide cooling.

Optionally, the refrigerant proceeds through a first path of a recuperator 16*a* in between the condenser and expanders, and a second path of a recuperator 16*b* in between the evaporator and compressors. The recuperator may be a suction-side heat exchanger. The recuperator causes exchange of heat between the liquid refrigerant arriving from the condenser and the cooler evaporated refrigerant coming from the evaporator. This heat exchange enables the refrigerant to be at a more moderate temperature during the compression and expansion processes.

In the liquid cycle, a liquid is continuously pumped between the compressors 12, the expanders 18, and a liquid storage tank 24. Liquid pumps 22 are used to pump the liquid from the storage tank to the compressors and expanders. In the compressors 12, the liquid is used to compress the gas, and, in the expanders, the compressed refrigerant drives out the liquid from the expander as the refrigerant expands. This liquid is then fed back to the compression units to assist in the gas exhaust function. These functions will be described in detail in connection with FIGS. 2A-2D.

In general, the systems and methods described herein are designed to operate at pressure ranges of between approximately 40-100 bar and temperature ranges of between approximately 20 to 50° C. Specific temperature and pressure values for one specific embodiment will be discussed below.

In exemplary embodiments, the liquid is water and the refrigerant is carbon dioxide. These examples will be used throughout the remainder of the present disclosure.

Figure 2A:
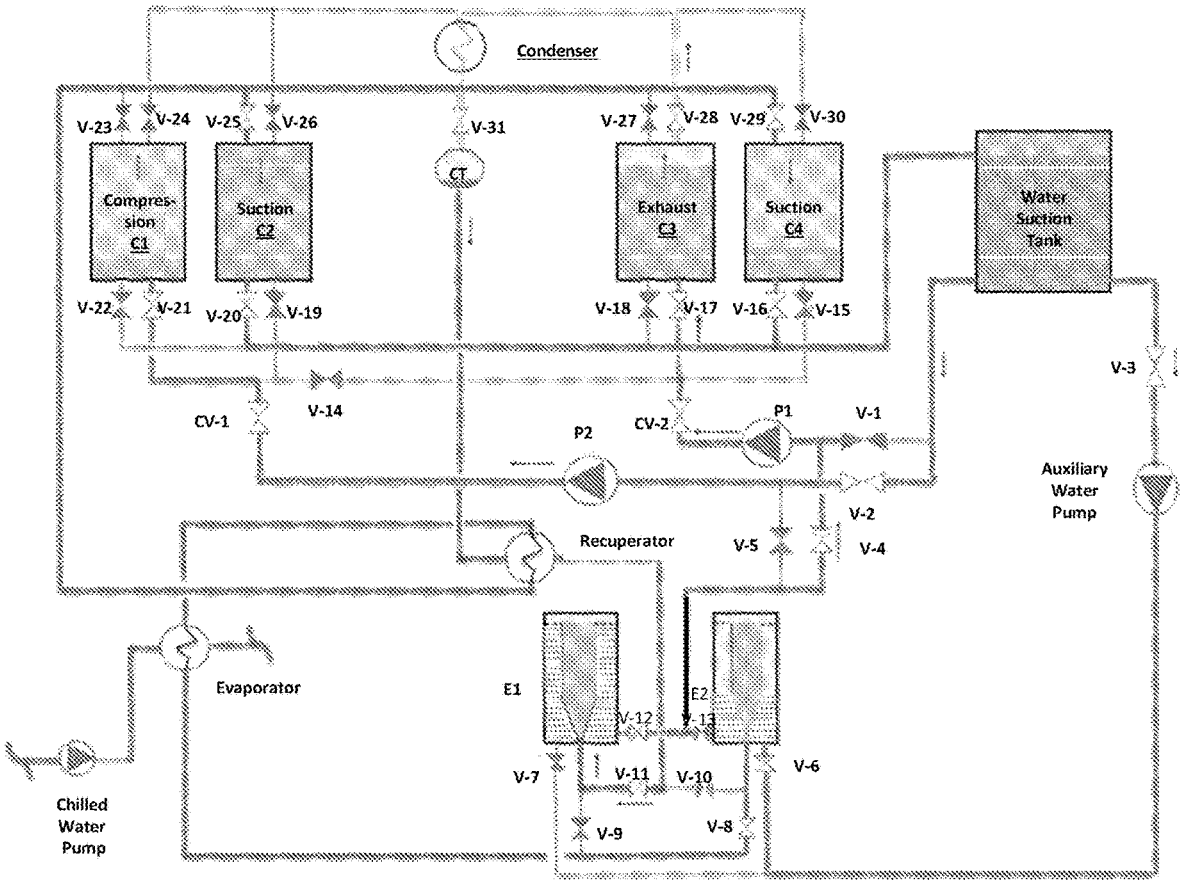
FIGS. 2A-2D illustrate a more detailed embodiment of a cooling system, including four compression cylinders and two expanders, in four respective stages of a cooling cycle, according to embodiments of the present disclosure.
Figure 2B:
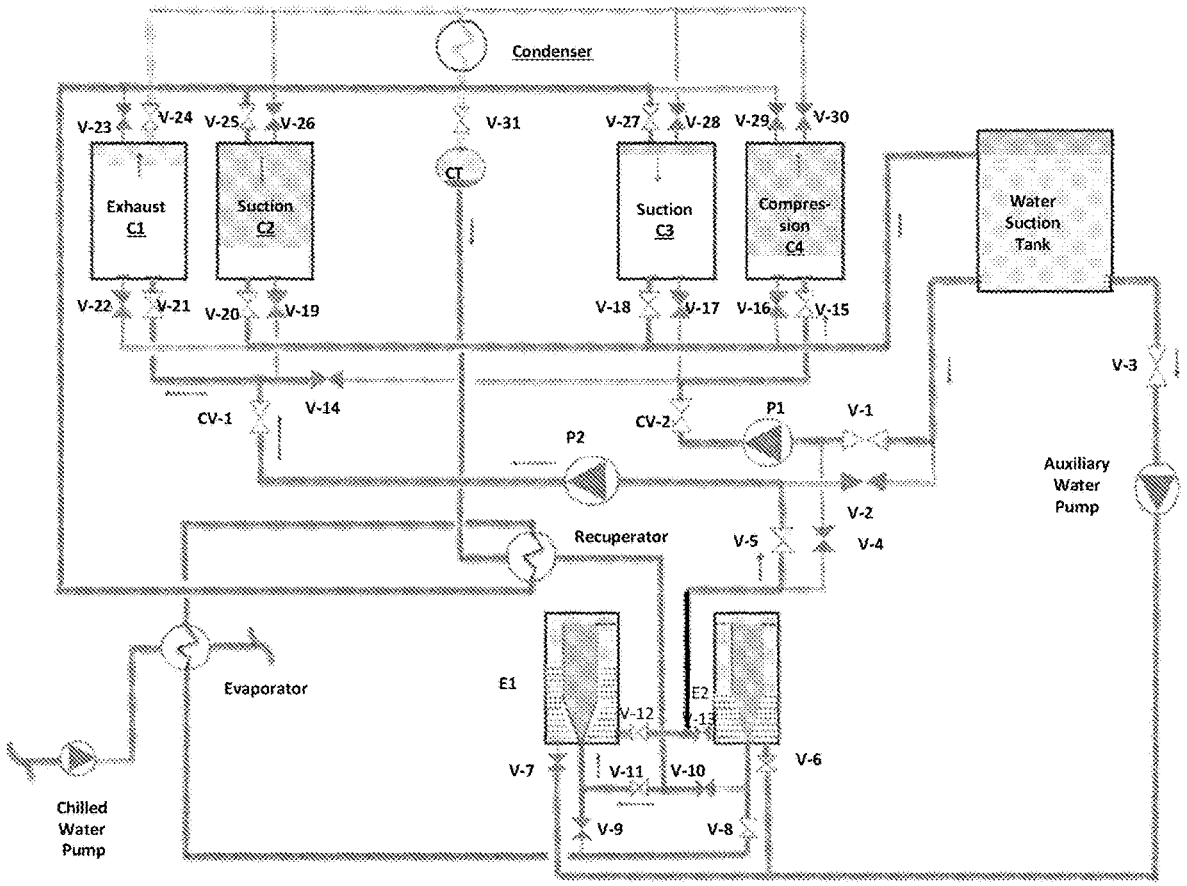
Figure 2C:
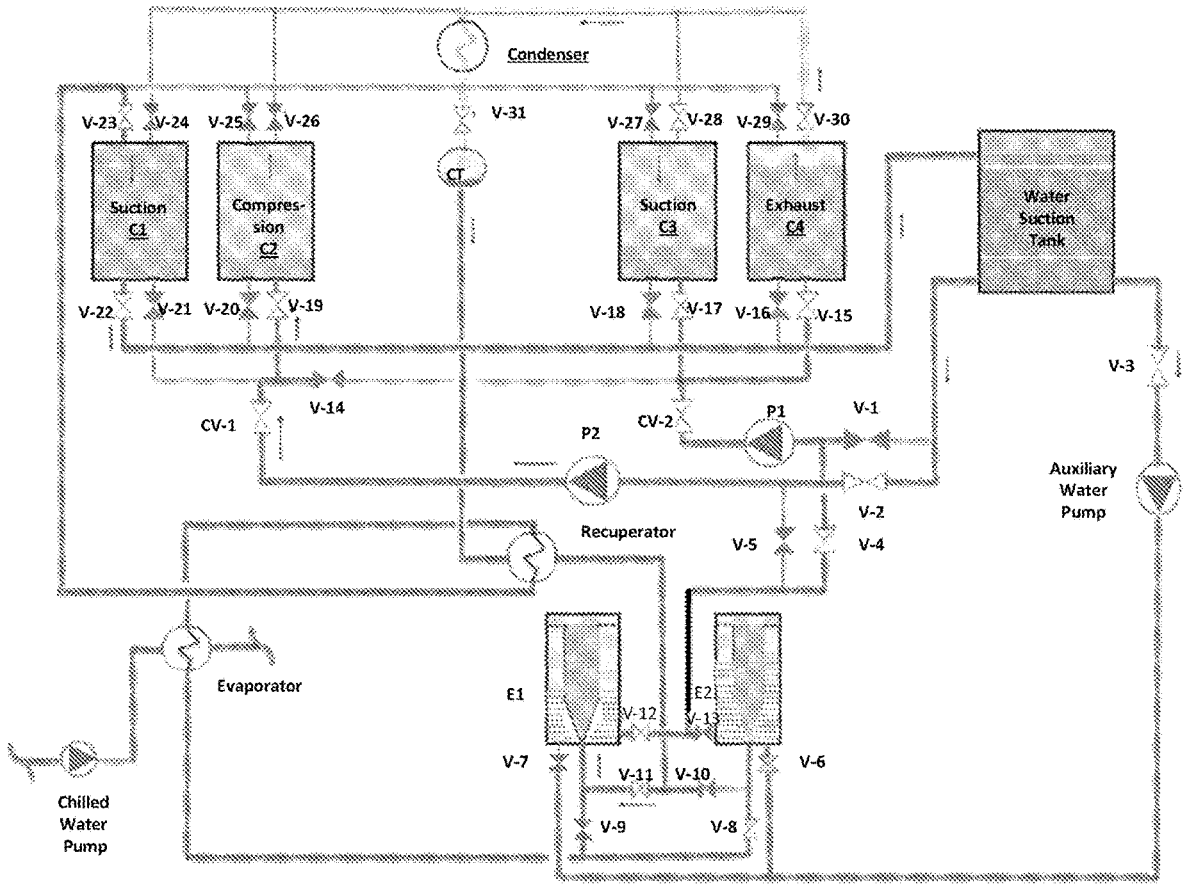
Figure 2D:
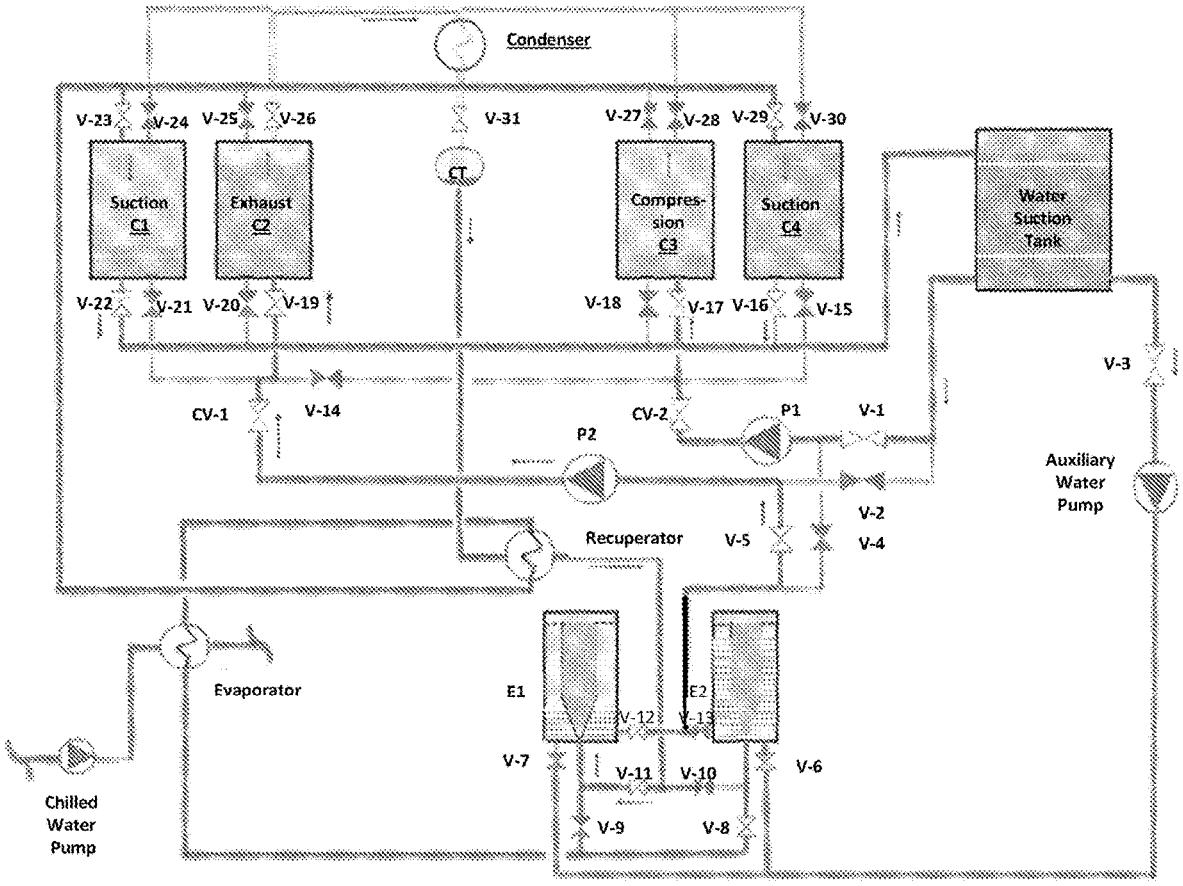

FIGS. 2A-2D illustrate the operation of embodiments of the system in four stages. In the illustrated embodiments, an entire cycle takes 20 seconds. Thus, the illustrations of FIGS. 2A-2D are spaced at 5 second intervals from each other. FIG. 2A represents seconds 0-5 of the 20 second cycle; FIG. 2B represents seconds 5-10; FIG. 2C represents seconds 10-15, and FIG. 2D represents seconds 15-20. As can be readily understood by those of skill in the art, the length of each cycle may depend on various factors, and need not be exactly five seconds. However, regardless of the length of each cycle, the ratio of the length of each part of the cycle relative to the other may be essentially constant.

As the system progresses from the view of FIG. 2A to that of FIG. 2D, different valves open and close. This opening and closing of the valves permits different routes of liquid between the water suction tank, compressors, and expanders, as well as different pathways of refrigerant through the different compressors and expanders. These valves may be opened and closed through operation of a controller (not shown) that is programmed to open and close the valves in sequence. The valves may be of any suitable configuration for performing the functions described herein. For example, the valves may be solenoid valves.

As the system progresses from the views of FIGS. 2A-2D, at various points different valves are open and closed. An open valve is indicated by an outline of a valve symbol, while a closed valve is indicated with a filled-in valve symbol.

Referring to FIG. 2A, compressors C1, C2, C3, and C4 are liquid-gas compressors, also referred to herein as compression cylinders. Compressors C1-C4 are identical. The compressors include inlet and outlet connections at the top to refrigerant supply lines. The compressors further include connections to a water pump discharge line and outlets to a water suction tank. In the embodiments illustrated in FIG. 2A, the water pump discharge line introduces water via the bottom of the compressors; other configurations are possible, as will be described further herein.

The compressors are configured to suction therein gas at relatively lower pressure, and to compress the gas therein to high pressure. In exemplary embodiments, the gas is carbon dioxide. The carbon dioxide is received at pressure of 38.6 bar, and is compressed to a pressure of 70 bar. This compression is a "subcritical compression" in that the carbon dioxide remains at a temperature that is below the critical point of the carbon dioxide, which is 73.8 bar and 31.0° C.

In each of the views, the compressors are in different stages of the suction and compression cycles. In the view of FIG. 2A, compressor C1 is in a compression state. Compressor C1 is nearly full with carbon dioxide gas, and is taking in water in order to compress the carbon dioxide. Gas inlet valve V23 and gas outlet valve V24 are closed, preventing exit of the carbon dioxide. Water is being pumped into water inlet valve V21, while water outlet valve V22 is closed. The source of this water entering V21 is the water suction tank. Water leaves the water suction tank, exits through open valve V2, through pump P2, through valve CV-1, and into valve V21.

Still referring to FIG. 2A, compressor C2 is in a suction mode, meaning that it is suctioning lower pressure gas in via valve V25, while gas outlet valve V26 is closed. Water is draining via water outlet valve V20 and entering the water suction tank, while water inlet valve V19 is closed. The water draining from the water outlet valve V20 proceeds to the water suction tank. The draining of the water causes a vacuum to form in the compressor, which enables drawing in of gas via valve V25, as soon as the pressure in the compressor is lower than the pressure of the gas.

Compressor C3 is in an exhaust mode. Compressed gas is being exhausted via gas outlet valve V28, while gas inlet valve V27 is closed. Water enters compressor C3 via inlet valve V17. The source of the water is the expander E1. Water leaving expander E1 is pumped through valve V4, through pump P1, valve CV-2, and valve V17.

Finally, compressor C4 is also in a stage of suction, albeit in a more advanced stage of suction than that of C2. Thus, refrigerant gas intake valve V29 is open; refrigerant outlet valve V30 is closed, water outlet valve V16 is open, permitting outflow of water to the water suction tank; and water inlet valve V15 is closed.

As can be readily seen, the compressors C1-C4 progress through four stages: an initial suction phase (illustrated in FIG. 2A in C2); a completion of suction phase (illustrated in C4); a compression stage (illustrated in C1); and an exhaust phase (illustrated in C3). As the cycle progresses, each compressor may spend an approximately equal amount of time in each phase before progressing to the next phase. In exemplary embodiments, this amount of time is 5 seconds. Thus, in the progression from FIG. 2A to FIG. 2D, compressor C1 proceeds from compression to exhaust to initial suction and to final suction. Compressor C2 proceeds from initial suction to final suction to compression to exhaust. Compressor C3 proceeds from exhaust to initial suction to final suction to compression. Finally, compressor C4 proceeds from final suction to compression to exhaust to initial suction. Each of these phases is accompanied by opening and closing of the appropriate water and gas inlet and outlet valves, as is apparent through examination of the Figures. In general, during the compression phase, the gas inlet and outlet valves are closed, the water inlet valve is open for receiving water from the water suction tank, and the water outlet valve is closed. During the exhaust phase, the gas inlet valve is closed, the gas outlet valve is open, the water inlet valve is open for receiving water from the expanders, and the water outlet valve is closed. During the suction phases, the gas inlet valve is open, the gas outlet valve is closed, the water inlet valve is closed, and the water outlet valve is open.

Figure 5A:
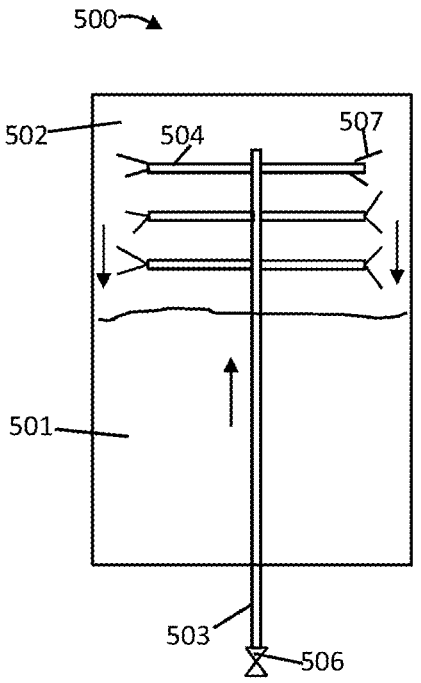
FIGS. 5A-5B illustrate structures of the liquid inlets of the compression cylinders for enabling cooling of the compression cylinders during isothermal compression, according to embodiments of the present disclosure.
Figure 5B:
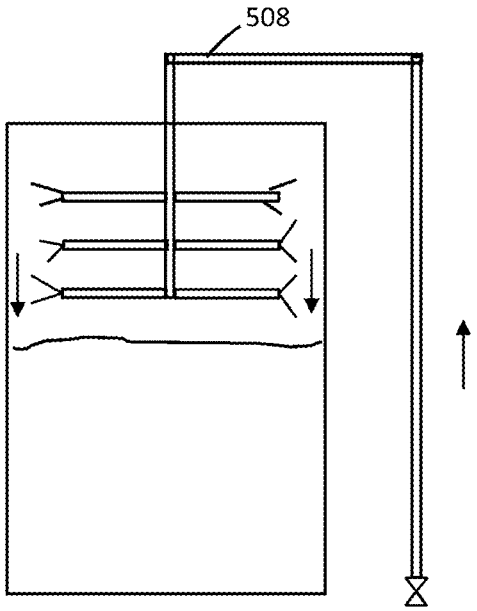

In the illustrated embodiments, the water is depicted as entering the compressor from the bottom and filling upwards. In preferred embodiments, the water enters the compressor from the top, such that the water entering the compressor may also serve to cool the compressed gas. This may proceed in various configurations, two of which are illustrated in FIGS. 5A-5B. In FIG. 5A, a cylinder 500 includes water 501 at the bottom and gas 502 at the top. Water enters the bottom of the cylinder 500 via entry tube 503, which is opened or closed by valve 506. The water proceeds through radial tubes 505, and exits the radial tubes in a spray 507. The water then passes through the compressed gas, by operation of gravity, and proceeds to the bottom of the cylinder 500. The water, being of lower temperature than the compressed gas 502, cools the compressed gas so that the compression proceeds quasi-isothermally, with only a minimal increase in temperature (e.g., from 23° C. to 29° C.). The embodiment of FIG. 5B proceeds essentially equivalently, except that the water enters the top of the compression cylinder 500 via exterior tube 508.

In order for the water to cool the refrigerant, without an external supply of cooling for the water, it is of course necessary for there to be an available source of water at the required temperature. Depending on the location, season, and time of day, the temperature of ambient water may be above 23° C., for example, 25-26° C. Under such circumstances, the most energetically advantageous manner to conduct the compression is to proceed in two stages: adiabatic compression until the temperature of the gas rises to the temperature of ambient water, and, from that point onward, quasi-isothermal compression with cooling supplied by the ambient water.

Returning to FIGS. 2A-2D, the water suction tank is used to store water that drains out of each compression cylinder during the suction phases, and that is subsequently pumped into the compression cylinders during the compression phases. Two pumps P1 and P2 are configured between the water suction tank and the compression cylinders. The flow of liquid between the water suction tank and the compression cylinders is controlled by valves V1 and V2. When valve V1 is open, water exiting the water suction tank flows through pump P1, and when valve V2 is open, water exiting the water suction tank flows through pump P2. In the illustrated embodiments, valves CV1 and CV2 are always open, and valve V14 is always closed, such that water from pump P1 always flows to either C3 or C4, and water from P2 always flows to C1 or C2. As may be readily understood, opening of valve V14 would permit flow from each respective pump to the other compression columns.

In view of the foregoing, it is apparent that there is duplication in both the compression units C1-C4 and in the pumps P1 and P2. That is, both the compression units and the pumps have elements that perform the same actions, albeit at different times. One advantage of this duplication is that it enables the system to run constantly. At any given moment, there is always a compression cylinder in the compression mode, which receives liquid from the water suction tank via one of the pumps, and there is always a compression cylinder in the exhaust mode, which receives liquid from the expanders via the other one of the pumps. There is no down time of the pumps P1 and P2.

Following the exhaust of the compressed gas, the compressed gas enters the condenser. The condenser condenses the compressed carbon dioxide into a liquid, in a manner known to those of skill in the art. In exemplary embodiments, the condensation process is performed in a subcritical process. The liquid refrigerant exits the condenser at 70 bar and 29° C. The liquid refrigerant passes through valve V31 (which, in the illustrated examples, is always open) and is collected in a condensate tank CT.

From the condensate tank CT, the liquid carbon dioxide proceeds to the first path of the recuperator. In the recuperator, the liquid carbon dioxide transfers some of its heat to the evaporated carbon dioxide in the second path of the recuperator. This enables the carbon dioxide to proceed to the expander at a lower temperature which is more suitable for operation of the expander. Specifically, in exemplary embodiments, the liquid which exited the condenser at 70 bar and 29° C. exits the recuperator at 69.6 bar and 24.7° C.

From the recuperator, the liquid carbon dioxide proceeds to the expanders E1 and E2. Expanders E1 and E2 are identical and operate in parallel. Each expander includes an inner cavity which is filled with liquid refrigerant, and an outer cavity which is alternatively filled with liquid or gaseous refrigerant. The structure of the expanders E1, E2 helps ensure that gaseous refrigerant always serves as a buffer between the liquid water and the liquid refrigerant.

During each cycle of the four condensing cylinders, the expanders E1, E2 proceed through half a cycle. Thus, over two cycles of the condensing cylinders, the expanders proceed through a complete cycle.

In one half-cycle, the outer cavity of the expander is filled with water from the water suction tank. This water is conveyed through valve V3 and the auxiliary water pump. When valve V6 is open, the water is pumped into expander E2, and when valve V7 is open, the water is pumped into expander E1. Pumping of water into the outer cavity of expander E1 or E2 displaces expanded refrigerant therefrom, through valve V8 or V9, toward the evaporator. The pressure of the expanded refrigerant is slightly above that of the pressure of the refrigerant within the evaporator, thus ensuring that the refrigerant flows to the evaporator without any further pumping. In particular, in exemplary embodiments, the refrigerant exits the expander as a saturated mixture of gas and liquid. The pressure of the refrigerant is 38.7 bar, the temperature is 4° C., and the vapor fraction of the refrigerant (the percentage that is gaseous) is 33%. Upon entering the evaporator, the refrigerant is at a pressure of 38.6 bar.

In the other half-cycle, the expander fills with condensate from the condensate tank. Part of the condensate evaporates during the expansion. The refrigerant expands in the expander, and displaces water that had previously been pumped into the outer cavity of the expander. This water is routed through valve V12 or V13 toward the compressing cylinders. Specifically, as discussed above, the water is pumped toward the compressing cylinder which is exhausting compressed gas.

As is apparent from the drawings, for the expanders to function, it is not necessary for the expanders to completely fill with either refrigerant or water. At all times in the cycle, there is a residual amount of the other material in the expander (refrigerant or water). An amount of carbon dioxide vapor is always present in the expander between the water and the carbon dioxide liquid, to serve as a separating buffer.

One reason for directing the water from the expanders specifically to the cylinder that is exhausting gas is that the exhaust function requires less pressure than the compression function. Specifically, during the exhaust function, it is necessary to replace the volume of the exiting gas with water, so that the remaining compressed gas within the cylinder remains at the desired pressure. However, it is not necessary to pressurize the remaining gas. As a result, the exhaust function is suitably performed without any increase in pressure. Furthermore, because the water displaced from the expanders is supplied at a higher pressure than the water in the suction tank, the energy required to supply the pressurized water through pump P1 or P2 is correspondingly lowered. By contrast, the pumping of water through the auxiliary water pump to displace the expanded gas may proceed at a relatively low pressure, which is not much higher than 1 bar. Thus, through the work of the expander, delivery of the water to the expander at a relatively low pressure enables exhaust of compressed gas at a much higher pressure.

Referring to the sequence of FIGS. 2A-2D, this time focusing on the expanders, in the view of FIG. 2A, the external cavity of expander E1 is full of water, and the external cavity of expander E2 is mostly expanded refrigerant. Water is entering expander E2 through valve V6, which is displacing a liquid-gas mixture of carbon dioxide through valve V8. Condensed carbon dioxide is entering the expander E1 through valve V11. The entry of the condensed carbon dioxide causes displacement of water from expander E1. The displaced water flows through valve V4, and eventually (in the state of FIG. 2A) to compression cylinder C3, which is in the exhaust state.

As the system progresses from the views of FIG. 2A through FIG. 2D, expander E1 continues to fill with liquid carbon dioxide, which expands to thereby displace water, and expander E2 continues to fill with water to thereby displace the saturated liquid-vapor mixture of carbon dioxide. From the perspective of the expanders, the only difference is with respect to the opening and closing of different valves between the expanders and the compression cylinders, so that the liquid is directed to the compression cylinder that is in the exhaust state, as discussed.

During a subsequent cycle, the roles of expanders E1 and E2 would reverse. That is, in the subsequent cycle, expander E1 would fill with water, displacing the liquid-vapor mixture of carbon dioxide, and expander E2 would fill with condensed carbon dioxide, displacing water.

As discussed in connection with the pumps and with the compression cylinders, the duplication of E1 and E2 increases the efficiency of the system. At all times, one of the expanders is engaged in expansion of refrigerant, and one of the expanders is evacuating expanded refrigerant to the evaporator.

The use of the expanders provides two distinct energetic advantages compared to use of an expansion valve. First, as discussed, the displacement of liquid by the expansion process reduces the energy required for the compression of the liquid refrigerant. In a 5 TR (ton refrigerant) system, using the pressure and temperature values discussed above, the energy required for the compression is reduced by up to approximately 25%.

Figure 4A:
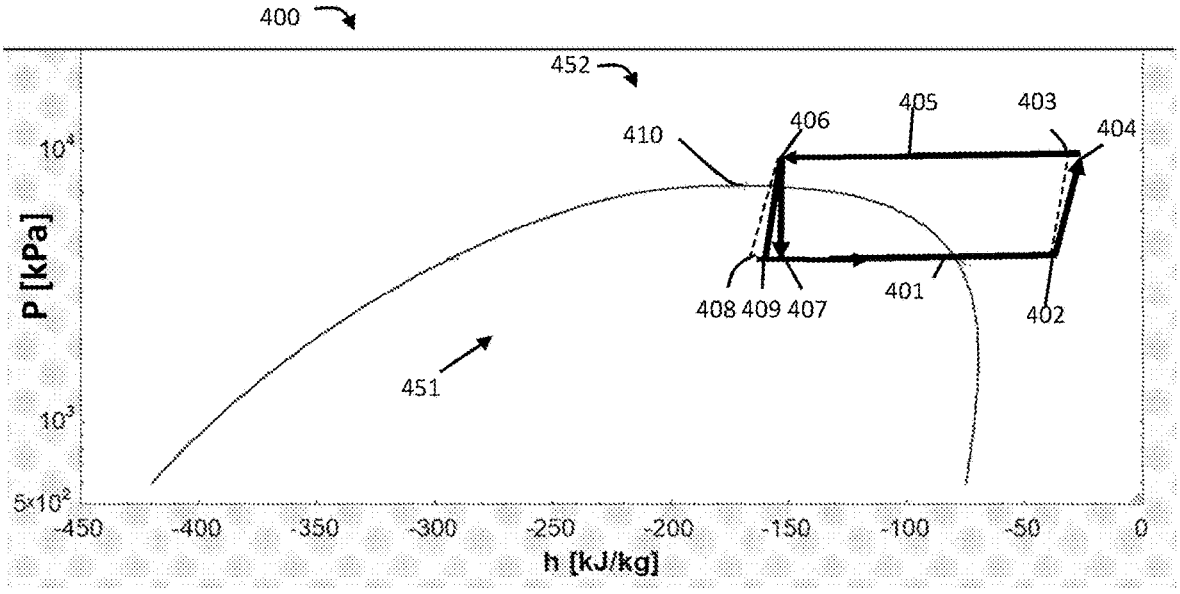
FIGS. 4A-4E illustrate energy savings from isothermal versus adiabatic compression, according to embodiments of the present disclosure.
Figure 4B:
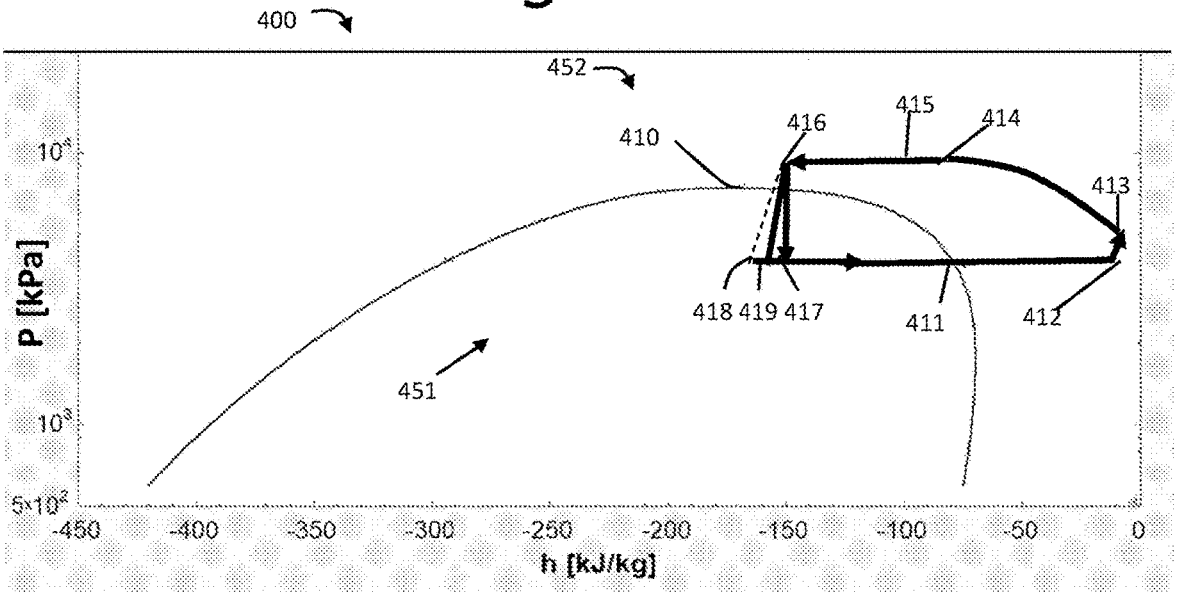
Figure 4C:
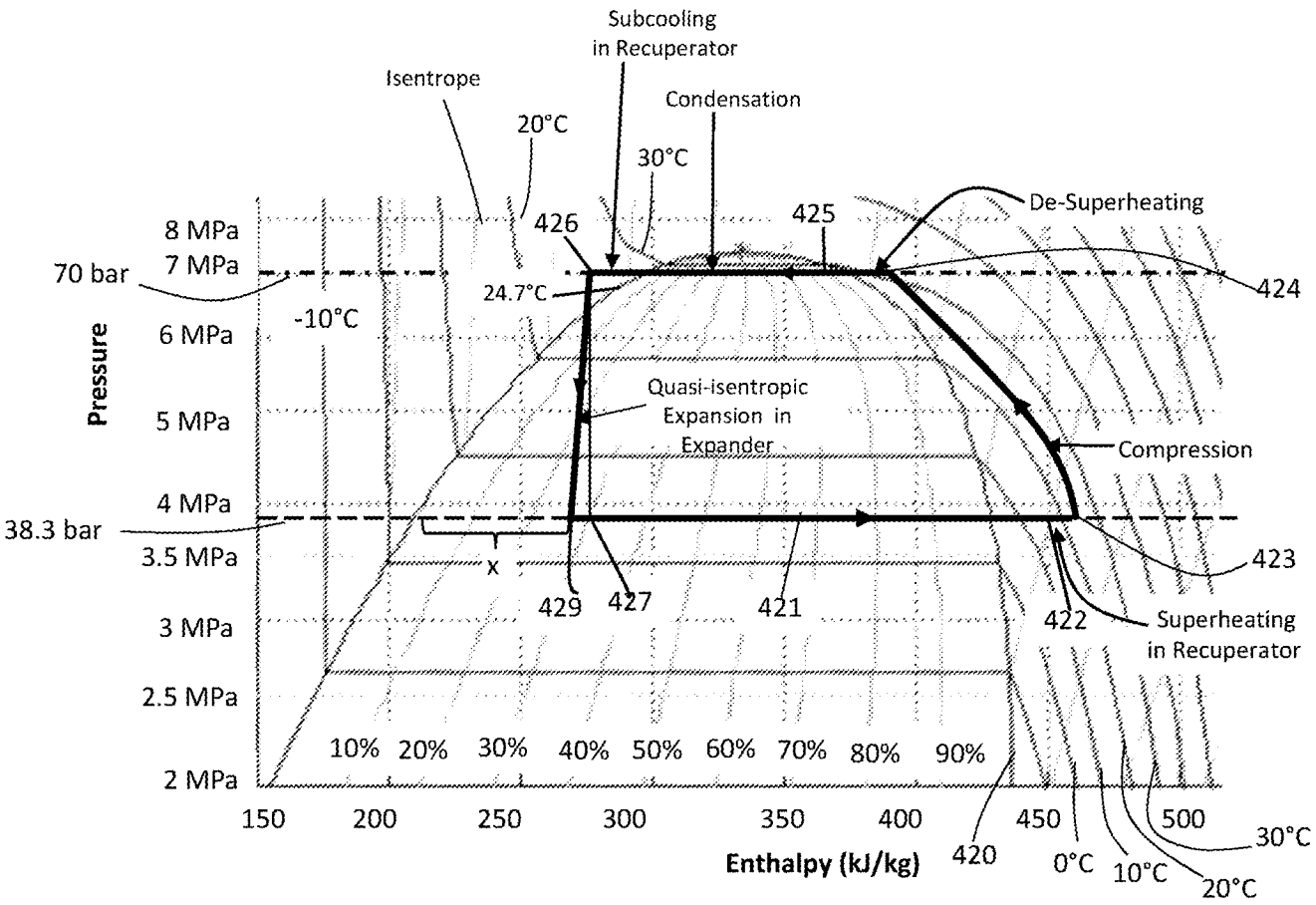

Second, the expansion proceeds in a nearly isentropic process. The difference between an isenthalpic expansion process and an isentropic expansion process may be seen in FIG. 4C. In FIG. 4C, the theoretical transition from state 426 to state 427 is an isenthalpic process. In this process, a high percentage of the liquid refrigerant evaporates. By contrast, the transition from state 426 to state 429 is a quasi-isentropic process, with around 85% efficiency. The isentropic process results in a relatively low vapor fraction of approximately 28%-36% upon entry into the evaporator. The low vapor fraction results in energy savings during the evaporation process, as less energy is required to evaporate condensed refrigerant as opposed to refrigerant that is already in the vapor state. For a 5 TR system, this energy savings may be up to an additional 17%.

Figure 6A:
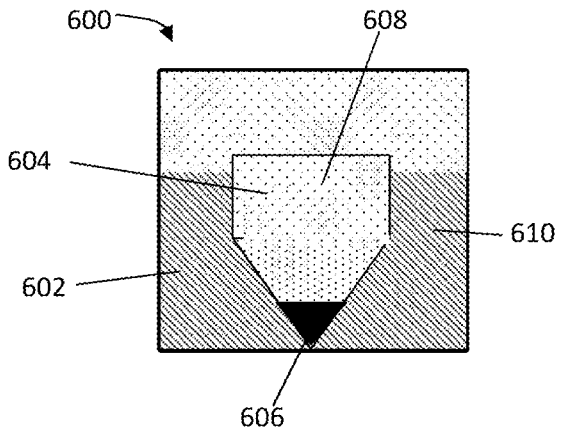
FIGS. 6A-6C illustrate additional aspects of the geometry of the expanders, according to embodiments of the present disclosure.
Figure 6B:
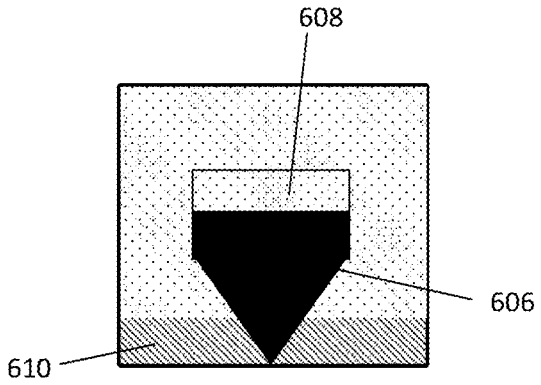
Figure 6C:
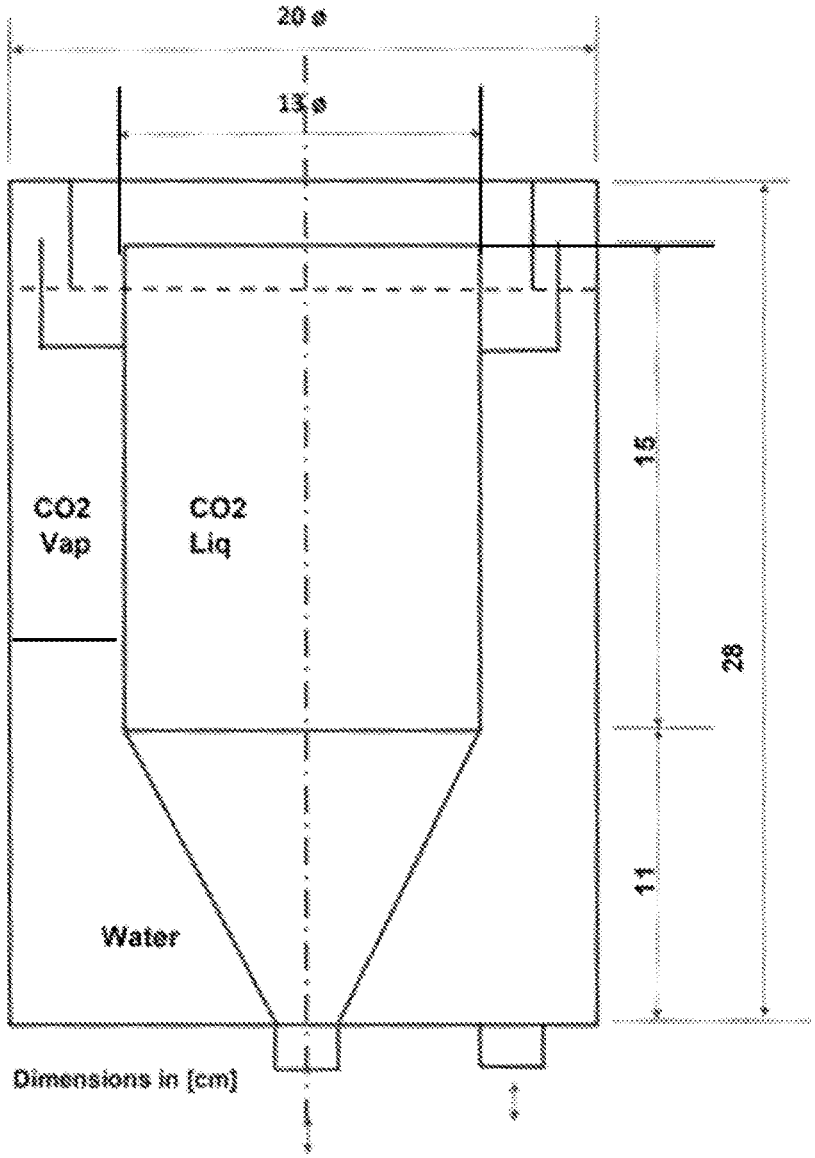

Further aspects of the geometry of the expanders are described infra in connection with FIGS. 6A-6C.

From the expanders, the refrigerant proceeds to the evaporator. In exemplary embodiments, as discussed, the refrigerant proceeds to the evaporator at approximately 38.6 bar and 4° C., and a vapor fraction of 33%. Advantageously, due to the operation of the expander, the refrigerant reaches the evaporator at a pressure and vapor fraction that fits the operating conditions of the evaporator. In the evaporator, heat is transferred from the water coming from the chilled water pump to the refrigerant. This heat transfer, in turn, chills the water pumped by the chilled water pump. For example, water may enter from the chilled water pump at 12° C. and exit at around 6-7° C. This chilled water is used for cooling, for example of a building. The refrigerant exits the evaporator at approximately 38.6 bar and 4° C., and a vapor fraction of 100%.

From the evaporator, the refrigerant proceeds to the second path of the recuperator. In the second path of the recuperator, the evaporated refrigerant receives heat from the condensed refrigerant in the first path of the recuperator. For example, in the second path, the refrigerant may rise from a temperature of 4° C. to a temperature of 23° C., and a pressure of 38.3 bar. This, in turn, enables the refrigerant to be returned back to the compression units at a more suitable temperature for compression.

Finally, the refrigerant proceeds to the inlet valves of the compression cylinders. Depending on the phase of the compression cycle, any two of valves V23, V25, V27, or V29 is open, permitting suction of the gas into the compression cylinders.

Figure 3:
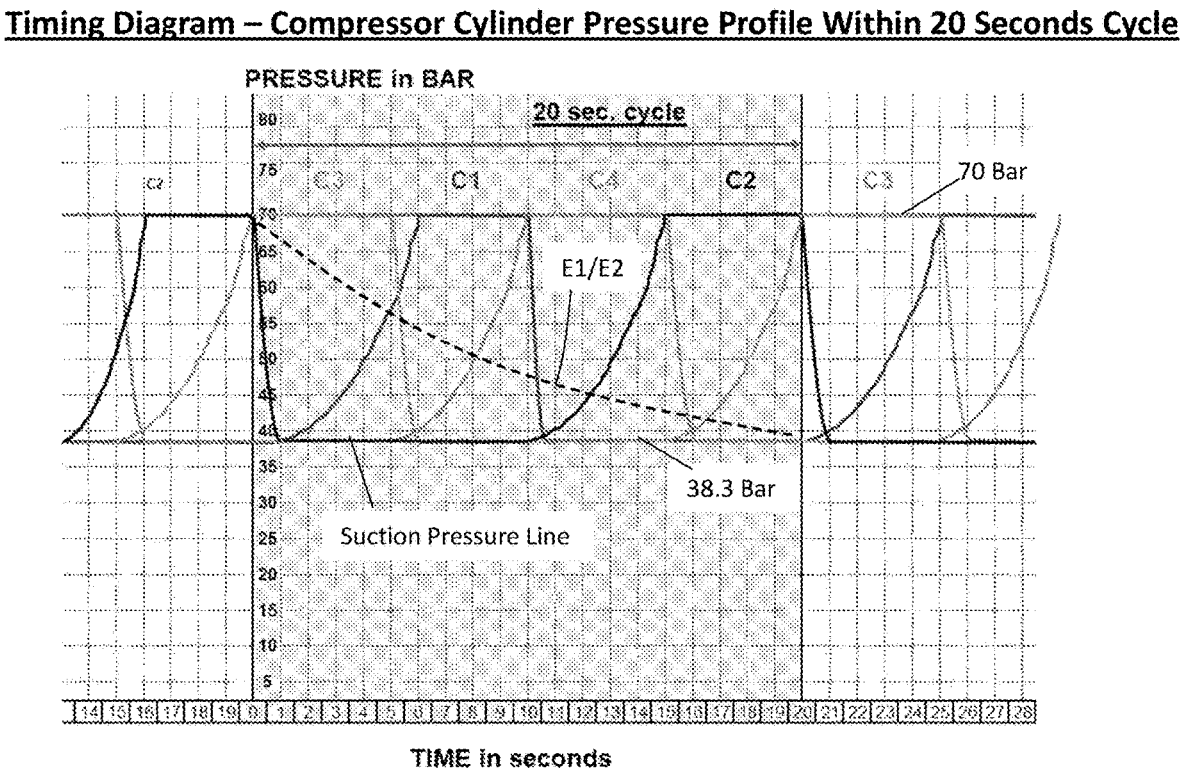
FIG. 3 illustrates a pressure diagram for each of the four compression cylinders and the expanders during the four stages of the cooling cycle illustrated in FIGS. 2A-2D.

FIG. 3 illustrates the state of the pressure at different locations in the system, during each of the phases of the 20 second compression cycle. Each cylinder that is in the exhaust phase is at a constant pressure of 70 bar, and each cylinder that is in a suction phase receives gas at a constant pressure of 38.3 bar. The suction pressure line between the recuperator and the inlet valves of the compression cylinders is likewise at 38.3 bar. The increase in pressure from 38.3 bar to 70 bar during the compression phase takes approximately 5 seconds. Following this, each cylinder spends approximately 5 seconds in the exhaust phase, and the decrease in pressure from the exhaust phase to the suction phase takes approximately 1 second.

At the same time, and referring to the dashed line in FIG. 3, the expander which had previously been filled with water and condensed refrigerant (E1, in the views of FIGS. 2A-2D) gradually reduces in pressure. At the start of a cycle, the refrigerant is at a pressure of 69.6 bar, whereas, at the end of the cycle, the refrigerant is at 38.6 bar. In general, so long as the pressure in E1 is greater than 38.3 bar, the pumping of water from the expander reduces the energy required to pump the water during the compression stage.

Experimental results and calculations for the above-described system demonstrate excellent energetic efficiency. Energetic efficiency of a chiller is measured using the Coefficient of Performance (COP). COP is a ratio of useful heating or cooling generated compared to work spent, with a higher COP representing greater efficiency. For a 5 ton-refrigeration (TR) system, in which the conditions in the condenser are a pressure of 70 bar and temperature of 29° C., and the conditions in the evaporator are a pressure of 38.6 bar and a temperature of 4° C., the calculations provide a COP of 6.5. For a commercial system of 200 TR, with the same temperature and pressure conditions, the calculations provide a COP of 7.7.

Additional energy benefits may be achieved by performing the compression isothermally, rather than in an adiabatic process. An "adiabatic process" is a process in which compression is performed without transfer of heat between a compression unit and an outside environment. When a gaseous refrigerant is compressed in an adiabatic process, the temperature of the refrigerant increases. An "isothermal process" is a process in which compression is performed while maintaining the temperature of the refrigerant constant. In order to achieve an isothermal compression process for a gas, it is necessary to supply outside cooling to the compression unit, to compensate for the inherent increase in temperature of the gas resulting from an increase in pressure. In order to achieve an isothermal compression, during the compression phase, each compressor must be cooled via heat rejection to the ambient atmosphere. If complete isothermal conditions cannot be achieved, at least a partly isothermal compression provides energy advantages compared to adiabatic compression. The process described herein is nearly isothermal, in that the temperature of the refrigerant does rise during compression, from 23° C. to approximately 29-30° C. However, without supply of cooling, a corresponding increase of pressure of carbon dioxide from 38.6 bar to 70 bar would result in a much higher increase in temperature.

Isothermal compression is advantageous both for subcritical compression and for transcritical compression. FIGS. 4A and 4B demonstrate the energy advantages of isothermal compression in a transcritical process, which is sufficiently similar to a subcritical process, for the purposes of this demonstration. Each of FIGS. 4A and 4B depicts a pressure-enthalpy diagram for transcritical compression cycle of a refrigerant. The X-axis of each graph 400 is enthalpy (KJ/kg), and the y-axis is pressure (MPa). In both FIG. 4A and FIG. 4B, the critical point of carbon dioxide is indicated with reference numeral 410. Carbon dioxide that is within bell-shaped region 451 is a saturated mixture of liquid and vapor, while carbon dioxide that is in region 452 above the bell is supercritical.

In FIG. 4A, the compression process is adiabatic. Points 401-409 represent different steps in the adiabatic vapor compression cycle. Dry saturated refrigerant leaves the evaporator at 5° C. and 39.69 bar (state 401). The refrigerant is superheated to 46° C. at the same pressure (state 402) in a supply-side heat exchanger. The superheated gas is compressed adiabatically in the compressor (states 403 and 404) to the heat rejection pressure of 100 bar. Heat rejection to the ambient (state 405) takes place at constant pressure, followed by further cooling in the supply side heat exchanger at 41.74° C. (state 406). Then, the supercritical fluid expands in an isenthalpic expansion device (state 407) down to the evaporator pressure. Alternatively, the expansion is performed with an expander, either with isentropic expansion (state 408), or a more realistic adiabatic expansion with 0.85 isentropic efficiency (state 409).

In the isothermal process of FIG. 4B, similar processes are indicated at similar locations on the pressure-enthalpy graph, except that the reference numerals 411-419 are used in place of the reference numerals 401-409. The main difference between the isothermal process of FIG. 4B and the adiabatic process of FIG. 4A is that the process of FIG. 4B is performed nearly isothermally. The transition from state 412 to 413 involves an increase in 4° C., and the transition from state 413 to 414 is isothermal.

As can be seen from a comparison of FIG. 4A with 4B, in the adiabatic process, the compression increases the enthalpy of the gas. More enthalpy is introduced into the system in order to compress the gas, and more enthalpy is released during the expansion of the gas. In the isothermal process, however, the compression of the gas reduces the enthalpy. Less enthalpy is introduced during the compression process and less enthalpy is released during the cooling. The reduction in enthalpy is associated with more efficient heating and cooling.

In an exemplary embodiment, for cooling of a 200 TR system in a transcritical manner, the power consumption of the compressor pump, considering its internal efficiency, electrical motor efficiency and the variable speed driver sums up at 256 kWe. This power consumption is compared to the estimated power of 352 kWe needed by a conventional compressor and represents therefore a saving of about 27% in the electrical consumption of the system.

FIG. 4C illustrates the isothermal compression process applied to subcritical compression. Bell curve 420 represents the dividing line between liquid and gas, with the area under the curve being saturated liquid and vapor and the area over the curve being supercritical. In FIG. 4C, each of the parabolic curves under bell curve 420 represents a vapor fraction (x), with lower vapor fractions on the left and higher vapor fractions on the right. The isotherms are represented with substantially vertical lines on the left, substantially horizontal lines across the middle, and then curved lines on the right; isotherms are labeled for −10° C., 0° C., 10° C., 20° C., and 30° C. Isentropic lines are generally indicated as slightly slanted vertical lines; one such isentrope is marked. Pressure is indicated on the y-axis in the units of MPa, with 1 MPa equivalent to 10 bar.

Points 421-429 represent different steps in the subcritical refrigerant compression cycle. The evaporated refrigerant leaves the evaporator at 4° C. and 38.3 bar (state 421). The refrigerant is superheated to 23° C. at the same pressure (state 422) in a recuperator. The superheated refrigerant is compressed quasi-isothermally in the compressor (states 423 and 424) to the pressure of 70 bar and a temperature of 29° C. The refrigerant is then de-superheated in the condenser until the conditions are equivalent to those of curve 420, which permits condensation. At state 425, condensation takes place at constant pressure, followed by further subcooling in the recuperator to 24.7° C. (state 426). Then, the fluid refrigerant expands in an 85% efficient isentropic manner, to state 429. The resulting vapor fraction is lower than the corresponding vapor fraction in an isenthalpic expansion, which is illustrated in state 427. In addition, the process depicted in FIG. 4C has the energy benefits resulting from the near-isothermal compression, like the process discussed above in connection with FIG. 4B.

Figure 4D:
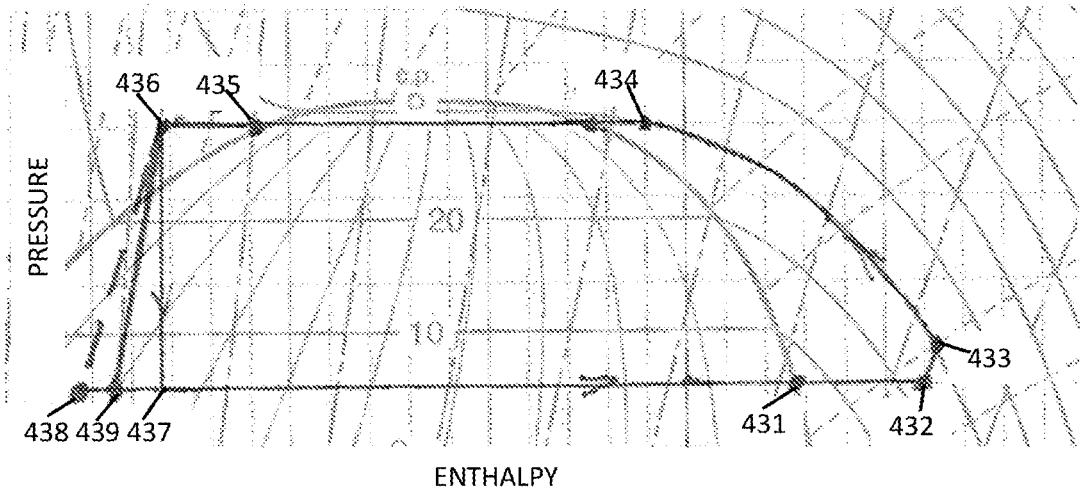

FIG. 4D illustrates a variation on the isothermal subcritical compression described in connection with FIG. 4C. Stages 431-439 of the refrigerant cycle are similar to stages 411-419 described in FIG. 4B and 421-429 described in FIG. 4C, and, accordingly, will not be reviewed in detail here. The process of FIG. 4D differs from that of FIG. 4C in that the compression proceeds in two stages: an adiabatic stage, from point 432 to point 433; and an isothermal stage, from point 433 to point 434. As discussed above, depending on the temperature of the ambient water, it may be necessary to raise the gas to the temperature of the ambient water in an adiabatic process before introducing the water to effect cooling during compression.

Figure 4E:
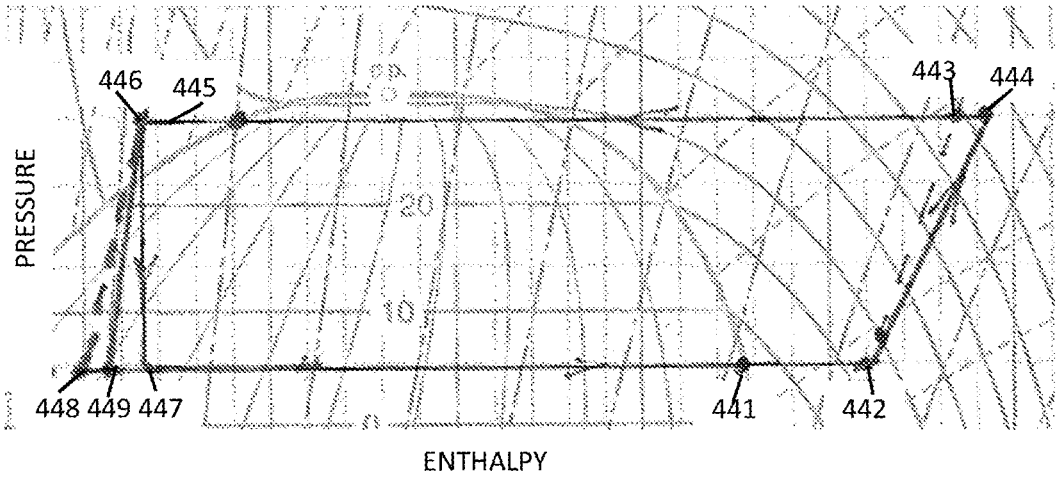

FIG. 4E depicts a subcritical refrigerant cycle with a completely adiabatic compression process. Stages 441-449 of the cycle are similar in most relevant respects to stages 401-409 of FIG. 4A, and, accordingly, they will not be reviewed in detail here.

Table 1 below illustrates calculations of COP for a 5 TR system operating according to the principles described above. The compression is performed in a subcritical manner, to a maximum pressure of 70 bar and a maximum temperature of 29° C. The COP is calculated for embodiments including separate use of the expanders and the use of isothermal compression, as well as combined use of expanders and isothermal compression.

TABLE 1

Calculation of COP for Cooling, Subcritical Cycle

| | Adiabatic compression, no expander | Adiabatic compression with Expander, not utilizing Expander Work | Adiabatic compression with Expander, Utilizing all Expander Work | Isothermal compression replacing adiabatic to maximum extent, not utilizing expander work | Isothermal compression replacing adiabatic to maximum extent, utilizing all expander work |
|---|---|---|---|---|---|
| Cooling Capacity (kJ/kg) | 166.4 | 170.7 | 170.7 | 170.7 | 170.7 |
| Net work of compression (kJ/kg) | 30.45 | 30.45 | 26.13 | 21.05 | 16.73 |
| COP | 5.465 | 5.607 | 6.532 | 8.112 | 10.2 |

While the data speaks for itself, a few observations are presented. First, the expander provides modest energetic benefits even without use of the work of the expanding refrigerant. These energetic benefits may relate at least in part to the prevention of freezing which is a common problem in expansion valves. In addition, using the expander work can additionally increase the cooling cycle efficiency and give a coefficient of performance (COP) as high as 10.2. As can be seen, the COP was greater when the expander work was utilized, and still greater for isothermal compression vs. adiabatic compression. This analytical calculation is a basis for a practical implementation that can give increased cooling efficiency of at least 20% compared to standard air conditioners.

Referring now to FIGS. 6A to 6C, the structure and function of embodiments of the expander are now considered in greater detail. One of the practical considerations when implementing the above-described system is ensuring that refrigerant flows in a sufficient flow rate during expansion in order to supply the desired degree of cooling. For example, to deliver 5 TR of cooling within 10 seconds would require flow of 0.103 kg/second. For a 10 second expansion, the refrigerant mass flow would be 1.03 kg. For the example of 20 seconds as described above, this flow rate would be halved. Even so, these flow volumes would require a corresponding tube length of many meters, which is impractical with tube-style heat exchangers.

To address this challenge, the expanders of the present disclosure have a relatively shorter tube length and a relatively larger tube cross section. This, in turn, results in a lower flow velocity.

FIG. 6A illustrates a configuration of the expander at the beginning of the expansion. Expander 600 includes inner chamber 602 and outer chamber 604. Each view of the expander 600 includes liquid carbon dioxide 606, vapor carbon dioxide 608, and liquid water 610. In FIG. 6A, the inner chamber 602 contains a minimum amount of liquid refrigerant (carbon dioxide), at 70 bar, 23° C., and 1.297 liters/kg, subcooled. The rest of the expander volume is filled with refrigerant vapor 608 and water 610, as shown. FIG. 6B illustrates the situation at the end of expansion. The outer chamber 604 of the expander has filled with expanded refrigerant, a total of 2.683 liters/kg, at 39.7 bar, and 5° C., saturated, with a vapor fraction of 0.2059.

In order to enable this change in the refrigerant, for a total amount of refrigerant of 1.03 kg, the expander may have the following dimensions. The diameter of the inner chamber 604 may be calculated based on the following equation: $(\pi*d^2/4)*d*4/3=2.683$ [Li/kg]*1.03 [kg]; therefore d=13.8 [cm]. Based on these calculations, it is possible to select (somewhat arbitrarily), for inner chamber 604, d=[13.0] cm with cylindrical height 15.0 [cm] and conical height of 11.0 [cm]. A receptacle with these dimensions would contain, when filled, 2.4762 liters. The total amount of refrigerant to be contained in this volume is 2.683 [Li/kg]*1.03 [kg] =2.763 [Li], of which 2.1945 [Li] is liquid, and the rest is gas, part of which overflows into the vapor space above.

Turning our attention to the annular volume 602 surrounding the inner chamber 604, it must contain water in its lower part, and refrigerant vapor in its upper part. An amount of refrigerant vapor is always present to serve as a buffer between the liquid refrigerant in the cylindrical/conical receptacle 604 and the water in the annular volume 602. Hence, it is possible to select (somewhat arbitrarily) its diameter D to be 20 [cm]. At the beginning of the expansion, when the receptacle in the middle 604 contains only a minimum amount of liquid refrigerant, the height of the water in the annular volume is selected to be 24 [cm] (same as the maximum height of the refrigerant in the cylindrical/conical receptacle). At the end of expansion, this height is reduced by 2.683 [Li/kg] *1.03 [kg]/$[\pi*(D^2-d^2)/4]$=2763 $[cm^3]/[\pi*(20^2-13^2)/4]$=15.23 [cm], that is, the height of the water in the annular volume 602 is about 9 [cm].

It is now possible to estimate the vapor velocity in the labyrinth at the top. The maximum flowrate of vapor at the end of expansion is 0.552 [Li/kg] *1.03 [kg]=0.569 [Li]. Assuming this flowrate has to pass through the annulus measuring $[\pi*(15^2-13^2)/4]$=44 $[cm^2]$ in 10 seconds, the estimated velocity is 1.3 [cm/sec].

The wall thickness required to contain the refrigerant at its maximum pressure of 70 Bar is: t=PD/26=7.0 [MPa] *0.2 [m]/(2*200 [MPa])=3.5E-03 [m]=3.5 [mm]

FIG. 6C shows the proposed geometry of the Expander in the proposed compact geometry, with dimensions indicated in cm. As may be readily understood, these values are merely examples corresponding to the cooling requirements and corresponding flow rates described above, and may vary according to the needs of a particular system.

Although, in the foregoing description, the system is described as a chiller, it is evident to those of skill in the art that the same system may be used, with minor modifications, to supply heating. In particular, instead of drawing heat from the surroundings at the evaporator in order to cool the surroundings, heat may be rejected to the surroundings at the condenser in order to heat the surroundings. The energy benefits that are realized in a chilling process are realized equally well in a heating process.

The following table summarizes the results of simulation of a transcritical carbon dioxide cycle, similar to that illustrated in FIG. 4B. The table is brought to illustrate that the similar energy benefits may be obtained whether using the system for heating or for cooling. For the purposes of this table, all adiabatic expansion and compression processes are assumed to occur at 0.85 isentropic efficiency. All heat transfer processes are assumed to take place with 5 C Closest Approach Temperature. The efficiency of pumps, variable speed drives (VSDs), and other peripheral equipment is assumed to be 100%. A realistic figure for the practical inefficiency of the combined pump, VSD, and electricity is about 0.8.

TABLE 2

Calculation of COP for Cooling and Heating, Transcritical Cycle

| Conditions of Heat Rejection 100 bar, 50° C. | Adiabatic compression, no expander | Adiabatic compression with Expander, not utilizing Expander Work | Adiabatic compression with Expander, Utilizing all Expander Work | Isothermal compression replacing adiabatic to maximum extent, not utilizing expander work | Isothermal compression replacing adiabatic to maximum extent, utilizing all expander work |
|---|---|---|---|---|---|
| Cooling Capacity (kJ/kg) | 101.4 | 113.7 | 113.7 | 113.7 | 113.7 |
| Net work of compression (kJ/kg) | 57.31 | 57.31 | 45.01 | 37.19 | 24.89 |
| $COP_C$ | 1.769 | 1.984 | 2.526 | 3.057 | 4.467 |
| Heating Capacity (kJ/kg) | 158.7 | 158.7 | 158.7 | 104.6 | 104.6 |
| Net work of compression (kJ/kg) | 57.31 | 57.31 | 45.01 | 37.19 | 24.89 |
| $COP_H$ | 2.769 | 2.769 | 3.526 | 2.812 | 4.201 |

As can be seen, the COP for heating is nearly equivalent to that for cooling.

In still another variation from the above-described embodiments, the system may be used for deep cooling, that is, for cooling below 0° C. To accomplish this, it is necessary to use a liquid other than pure water. In one example, the liquid may be a mixture of 60% ethylene glycol and 40% water. This mixture has a freezing point of −58° C. The refrigerant, in the case of carbon dioxide, undergoes transitions during the cycle of pressure from 82 bar to 7.5 bar, and temperature from approximately 30° C. to −47° C., which is the temperature upon entering the evaporator. The greater temperature range that is made available through the deep cooling process enables an even greater COP.

The invention claimed is:

1. A chiller, comprising:

a plurality of hydraulic compression units, each compression unit configured to compress a refrigerant at gaseous state with liquid and exhaust the compressed refrigerant;

a condenser for condensing the compressed refrigerant;

a plurality of expander units, each expander unit configured to expand condensed refrigerant into a vapor-liquid mixture, to displace liquid during expansion of the condensed refrigerant, and to displace the expanded vapor-liquid mixture of refrigerant through introduction of liquid;

an evaporator for evaporating the expanded refrigerant;

a conduit for delivering the evaporated refrigerant back to the hydraulic compression units; and a plurality of valves configured between the plurality of expander units and hydraulic compression units, such that the liquid displaced from each expander unit is delivered to a hydraulic compression unit to thereby assist in the exhaust of the compressed refrigerant.

2. The chiller of claim 1, wherein each compression unit receives liquid for compression alternatively from a suction tank or from one of the plurality of expander units.

3. The chiller of claim 1, wherein the compression units are arranged to operate in cycles of four stages: beginning of suction of refrigerant; advanced suction of refrigerant; compression; and evacuation of compressed refrigerant to a condenser.

4. The chiller of claim 3, wherein the compression units are arranged in groups of four, such that, at any given moment, each compression unit is operating a different stage of the four-stage compression cycle.

5. The chiller of claim 4, wherein, at any given moment, a first pump delivers liquid from a suction tank to the compression unit that is in the compression phase, a second pump delivers liquid from a first expander unit to the compression unit that is in the evacuation phase, and a third pump delivers liquid from the suction tank to a second expander unit.

6. The chiller of claim 4, wherein the plurality of expander units include two expander units for every group of four compression units, wherein, during each cycle of the four compression units, one of the two expander units fills with liquid from the suction tank, thereby displacing expanded refrigerant in a liquid-vapor mixture to the evaporator, and a second of the expander units fills with condensed refrigerant which expands therein into a liquid-vapor mixture, thereby displacing liquid for delivery to the compression unit that is in the evacuation phase.

7. The chiller of claim 6, wherein each expander unit contains an inner chamber with refrigerant in a liquid state, an outer chamber with liquid water, and refrigerant in vapor state between the inner and outer chambers, wherein the vapor refrigerant divides between the liquid state refrigerant and the liquid water.

8. The chiller of claim 1, wherein the evaporator is configured to draw heat from an ambient fluid to thereby evaporate the refrigerant while chilling the ambient fluid.

9. The chiller of claim 1, further comprising a recuperator, the recuperator comprising a first pathway configured between the condenser and plurality of expander units, and a second pathway configured between the evaporator and the plurality of the compression units, wherein the recuperator is configured to cool incoming condensed refrigerant in the first pathway and heat outgoing evaporated refrigerant from the second pathway.

10. The chiller of claim 1, wherein the liquid is water and the gas is carbon dioxide.

11. The chiller of claim 10, wherein, in the condenser, the carbon dioxide is pressurized to 70 bar and raised to a temperature of 29° C., and, upon entry into the evaporator, the carbon dioxide is at a pressure of 38.6 bar and at a temperature of 4° C.

12. The chiller of claim 1, wherein the liquid has a freezing point below 0° C., and, upon entry into the evaporator, the refrigerant is below 0° C.

13. A method of chilling, comprising:

compressing refrigerant with liquid in a plurality of hydraulic compression units;

exhausting the compressed refrigerant from the hydraulic compression units;

condensing the compressed refrigerant in a condenser;

expanding the condensed refrigerant in a plurality of expander units into a vapor-liquid mixture, thereby displacing liquid, delivering the displaced liquid from each expander unit to a hydraulic compression unit, to thereby assist in the exhaust of the compressed refrigerant, and displacing the expanded vapor-liquid mixture of refrigerant through introduction of liquid;

evaporating the expanded refrigerant in an evaporator; and delivering the evaporated refrigerant back to the hydraulic compression units.

14. The method of claim 13, further comprising alternatively delivering liquid to each compression unit from a suction tank or from one of the plurality of expander units.

15. The method of claim 13, further comprising operating the compression units in cycles in four stages: beginning of suction of refrigerant; advanced suction of refrigerant; compression; and evacuation of compressed refrigerant to a condenser.

16. The method of claim 15, wherein the compression units are arranged in groups of four, such that, at any given moment, each compression unit is operating a different stage of the four-stage compression cycle.

17. The method of claim 16, wherein, at any given moment, a first pump delivers liquid from a water suction tank to the compression unit that is in the compression phase, a second pump delivers liquid from a first expander unit to the compression unit that is in the evacuation phase, and a third pump delivers liquid from the water suction tank to a second expander unit.

18. The method of claim 16, wherein the plurality of expander units include two expander units for every group of four compression units, wherein, during each cycle of the four compression units, one of the two expander units fills with liquid from the water suction tank, thereby displacing expanded refrigerant in a liquid-vapor mixture to the evaporator, and a second of the expander units fills with condensed refrigerant which expands therein into a liquid-vapor mixture, thereby displacing liquid for delivery to the compression unit that is in the evacuation phase.

19. The method of claim 18, wherein each expander unit contains an inner chamber with refrigerant in a condensate state, an outer chamber with liquid, and refrigerant in vapor state between the inner and outer chambers, wherein the vapor refrigerant divides between the condensate refrigerant and the liquid.

20. The method of claim 13, further comprising, during the evaporating step, drawing heat with the evaporator from ambient fluid to thereby evaporate the refrigerant while chilling the ambient fluid.

21. The method of claim 13, further comprising cooling incoming condensed refrigerant in a first pathway of a recuperator configured between the condenser and plurality of expander units, and heating outgoing evaporated refrigerant in a second pathway of the recuperator configured between the evaporator and the plurality of the compression units.

22. The method of claim 13, wherein the liquid is water and the refrigerant is carbon dioxide.

23. The method of claim 22, wherein, in the condenser, the carbon dioxide is pressurized to 70 bar and raised to a temperature of 29° C., and, upon entry into the evaporator, the carbon dioxide is at a pressure of 38.6 bar and at a temperature of 4° C.

24. The method of claim 13, wherein the liquid has a freezing point below 0° C., and, upon entry into the evaporator, the refrigerant is below 0° C.

25. The method of claim 13, further comprising cooling the compression units during the compressing step to thereby compress the refrigerant in the compression units isothermally.

* * * * *